United States Patent [19]

Flanagan

[11] 4,092,190

[45] May 30, 1978

[54] HOT NITROGEN GENERATOR CONTAINING CALCIUM OXIDE

[75] Inventor: Joseph E. Flanagan, Woodland Hills, Calif.

[73] Assignee: Rockwell International Corporation, El Segundo, Calif.

[21] Appl. No.: 823,380

[22] Filed: Aug. 10, 1977

Related U.S. Application Data

[63] Continuation-in-part of Ser. No. 737,647, Nov. 1, 1976, abandoned.

[51] Int. Cl.[2] ..... C06B 35/00

[52] U.S. Cl. ..... 149/35; 149/61

[58] Field of Search ..... 149/35, 61

[56] References Cited

U.S. PATENT DOCUMENTS 3,947,300 3/1976 Passauer et al. ..... 149/35

*Primary Examiner*—Stephen J. Lechert, Jr.

*Attorney, Agent, or Firm*—L. Lee Humphries; Robert M. Sperry

[57] ABSTRACT

A solid propellant gas generator consisting of 45–65 weight percent calcium oxide, 25–45 weight percent calcium azide, and 8–11 weight percent calcium nitrate which produces pure nitrogen gas at temperatures above 2200° K in the complete absence of other gaseous products and metallic vapors.

5 Claims, No Drawings

HOT NITROGEN GENERATOR CONTAINING CALCIUM OXIDE

This application is a continuation-in-part application of Ser. No. 737,647 filed Nov. 1, 1976, now abandoned.

BACKGROUND OF THE INVENTION

1. Field of the Invention

This invention relates to gas generators and is particularly directed to solid propellant gas generators for producing pure nitrogen gas at temperatures above 2200° K in the complete absence of other gaseous products and metallic vapors.

2. Description of the Prior Art

Several solid propellant gas generators exist which are capable of producing warm, pure nitrogen gas. The majority of these gas generators are based upon alkali azides [sodium azide ($NaN_3$), potassium azide ($KN_3$), or lithium azide ($LiN_3$)]. The basic concept is to react the alkali azide with a fuel which leaves a solid residue and yields pure nitrogen gas. A typical example from U.S. Pat. No. 3,833,423 is:

$$xNaN_3 + y(CF_2)_n + zMg \longrightarrow \left\{ \underset{\text{Solid Residue}}{xNaF + zMgF_2 + yC} \right\} \left( + \frac{3x}{2} \right) N_2$$

Recent developements in gas dynamic lasers have indicated that when a source of hot nitrogen gas ($T > 2200°$ K) is mixed with cold carbon dioxide and water vapor, superior performance is obtained when compared to a system in which all the gases ($N_2$, $CO_2$ and $H_2O$) are produced in the hot state.

The state-of-the-art warm nitrogen generators are limited to the temperature range 1775 to 1960° K, the boiling points of the alkali halides (fluorides, and chlorides). The performance of a gas dynamic laser is severely degraded if volatile alkali metal atoms or alkali halide molecules are entrapped in the flowing gas stream.

U.S. Pat. No. 3,947,300 describes a warm nitrogen generator based upon the reaction:

$$M(N_3)_x + M(NO_3)_y + SiO_2 \rightarrow \text{Silicate Residue} + N_2$$

Where M = Na, K, Ca; $x$ and $y$ = 1 or 2

The basic concept of this reaction is to form a silicate glasslike residue and free nitrogen gas. However, thermochemical calculations indicate substantial portions of the silicate residue will begin to dissociate at temperatures above 2200° K yielding gaseous atoms of Na and K.

U.S. Pat. No. 3,814,694 suggests the utilization of calcium nitrate ($Ca(NO_3)_2$) in conjunction with a variety of reducing agents. However, large quantities of water vapor are generated in addition to nitrogen gas which would be very detrimental to the operation of a gas dynamic laser.

It is obvious that any compound containing an alkali metal atom cannot be used in a system where the flame temperature will exceed 2200° K.

BRIEF SUMMARY AND OBJECTS OF THE INVENTION

These disadvantages of the prior art are overcome with the present invention and a solid propellant gas generator is provided for producing pure nitrogen gas at temperatures above 2200° K in the absence of other gaseous products and metallic vapor.

The advantages of the present invention are preferably attained by providing a solid propellant gas generator comprising a mixture of calcium azide, calcium nitrate, and calcium oxide.

Accordingly, it is an object of the present invention to provide an improved nitrogen gas generator.

Another object of the present invention is to provide a solid propellant gas generator yielding nitrogen gas in the absence of other gaseous products and metallic vapors.

A further object of the present invention is to provide a solid propellant gas generator yielding nitrogen gas at temperatures above 2200° K.

A specific object of the present invention is to provide a solid propellant gas generator comprising a mixture of calcium azide, calcium nitrate, and calcium oxide.

These and other objects and features of the present invention will be apparent from the following detailed description.

DETAILED DESCRIPTION OF THE INVENTION

In the form of the present invention chosen for purpose of illustration, a solid propellant nitrogen gas generator is provided comprising a mixture of calcium oxide, calcium azide and calcium nitrate. The invention is limited to only one metallic element being present, that element being calcium. Calcium has been chosen since its oxide is the most thermally stable of the three alkaline earths (Ca, Ba, Sr) oxides.

Calcium azide has been chosen because it is sufficiently stable for storage purposes and contains 67.7% nitrogen by weight. Moreover, when calcium azide is blended in a 5:1 molar mixture with calcium nitrate and burned, the resulting flame temperature is 4234° K and the resulting reaction is $$5Ca(N_3)_2 + Ca(NO_3)_2 \rightarrow 6CaO + 16N_2$$

Calcium oxide is a solid up to 3123° K, but dissociates into gaseous calcium and oxygen above this temperature. However, these gases would be detrimental to the operation of a gas dynamic laser. On the other hand, it has been found that calcium oxide can be added to the calcium azide-calcium nitrate reaction to serve as a heat sink and, when a sufficient quantity of calcium oxide is added, the flame temperature of the reaction can be held below 3123° K. When this is done, the reaction yields only solid calcium oxide and gaseous nitrogen with no additional gaseous products or metallic vapors according to the reaction:

$$5Ca(N_3)_2 + Ca(NO_3)_2 + xCaO \rightarrow (6+x)\,CaO(\text{Solid}) + 16N_2\uparrow$$

EXAMPLE I

In a typical example, 31.64 weight percent of calcium azide was blended with 8.36 weight percent of calcium nitrate and 60.00 weight percent of calcium oxide. When burned, this mixture yielded a flame temperature of 2499° K and produced 22.85 weight percent of gaseous nitrogen.

EXAMPLE II

In another example, 39.35 weight percent of calcium azide was blended with 10.65 weight percent of calcium nitrate and 50.00 weight percent of calcium oxide. When burned, this formulation yielded a flame temperature of 2965° K and produced 28.56 weight percent of gaseous nitrogen.

Obviously, numerous other variations and modifications may be made without departing from the present invention. Accordingly, it should be clearly understood that the forms of the present invention described above are illustrative only and are not intended to limit the scope of the present invention.

I claim:

1. A solid propellant hot nitrogen gas generator system comprising:

calcium oxide as a heat absorbent calcium azide as the primary nitrogen source calcium nitrate as an oxidizing source for all the calcium present in the nitrogen source.

2. The gas generator of claim 1 wherein calcium oxide comprises up to about 60 percent by weight of said gas generator system.

3. The gas generator of claim 1 wherein a blend of calcium azide and calcium nitrate in a molar blend of 5:1 comprises up to about 50 percent by weight of said gas generator system.

4. A solid propellant hot nitrogen gas generator containing only one metallic element and no halogen species.

5. The gas generator of claim 4 wherein the metallic element is calcium.

* * * * *

UNITED STATES PATENT AND TRADEMARK OFFICE

CERTIFICATE OF CORRECTION

PATENT NO. : 4,092,190

DATED : May 30, 1978

INVENTOR(S) : Joseph E. Flanagan

It is certified that error appears in the above-identified patent and that said Letters Patent are hereby corrected as shown below:

Column 1, line 49, delete "$M(N_3)_x + M(NO_3)y + SIO_2 \rightarrow$ Silicate Residue +" and insert --$M(N_3)_x + M(NO_3)_y + SiO_2 \rightarrow$ Silicate Residue +.--

Signed and Sealed this

*Tenth* Day of *October 1978*

[SEAL]

*Attest:*

RUTH C. MASON
*Attesting Officer*

DONALD W. BANNER
*Commissioner of Patents and Trademarks*